US008686623B2

(12) United States Patent
Wheelock et al.

(10) Patent No.: US 8,686,623 B2
(45) Date of Patent: Apr. 1, 2014

(54) OMNI-DIRECTIONAL CHANNELING OF LIQUIDS FOR PASSIVE CONVECTION IN LED BULBS

(71) Applicant: Switch Bulb Company, Inc., San Jose, CA (US)

(72) Inventors: Glenn Wheelock, San Jose, CA (US); David Horn, Saratoga, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 13/963,943

(22) Filed: Aug. 9, 2013

(65) Prior Publication Data

US 2013/0328474 A1 Dec. 12, 2013

Related U.S. Application Data

(63) Continuation of application No. 13/984,022, filed as application No. PCT/US2012/023521 on Feb. 1, 2012.

(51) Int. Cl.
*F21V 29/00* (2006.01)

(52) U.S. Cl.
USPC ..... 313/36; 362/294; 362/373; 313/46; 313/22

(58) Field of Classification Search
USPC ..... 313/11–47; 362/294, 373
See application file for complete search history.

(56) References Cited

U.S. PATENT DOCUMENTS

| | | | |
|---|---|---|---|
| 4,651,047 | A | 3/1987 | Comberg et al. |
| 4,740,866 | A | 4/1988 | Kajiwara et al. |
| 5,594,424 | A | 1/1997 | Louy et al. |
| 5,791,770 | A | 8/1998 | Hoyt et al. |
| 5,847,366 | A | 12/1998 | Grunfeld |
| 5,890,794 | A | 4/1999 | Abtahi et al. |
| 5,927,094 | A | 7/1999 | Nickum |
| 6,525,668 | B1 | 2/2003 | Petrick |

(Continued)

FOREIGN PATENT DOCUMENTS

| | | | |
|---|---|---|---|
| EP | 1881259 | A1 * | 1/2008 |
| JP | 2009-21082 | A | 1/2009 |

(Continued)

OTHER PUBLICATIONS

International Search Report and Written Opinion received for PCT Patent Application No. PCT/US2012/23521, mailed on Jun. 7, 2012, 9 pages.

(Continued)

*Primary Examiner* — Mariceli Santiago
(74) *Attorney, Agent, or Firm* — Morrison & Foerster LLP

(57) ABSTRACT

An LED bulb has a base, a shell connected to the base, and a thermally conductive liquid held within the shell. The LED bulb has a plurality of LEDs mounted on LED mounting surfaces disposed within the shell. The LED mounting surfaces face different radial directions, and the LED mounting surfaces are configured to facilitate a passive convective flow of the thermally conductive liquid within the LED bulb to transfer heat from the LEDs to the shell when the LED bulb is oriented in at least three different orientations. In a first orientation, the shell is disposed vertically above the base. In a second orientation, the shell is disposed on the same horizontal plane as the base. In a third orientation, the shell is disposed vertically below the base.

27 Claims, 6 Drawing Sheets

(56) References Cited

U.S. PATENT DOCUMENTS

| | | | | |
|---|---|---|---|---|
| 6,682,211 | B2 | 1/2004 | English et al. | |
| 6,910,794 | B2 | 6/2005 | Rice | |
| 6,955,451 | B2 * | 10/2005 | Coushaine et al. | 362/294 |
| 7,150,553 | B2 * | 12/2006 | English et al. | 362/545 |
| 7,585,090 | B2 * | 9/2009 | Wu | 362/249.02 |
| 7,637,636 | B2 | 12/2009 | Zheng et al. | |
| 7,726,836 | B2 | 6/2010 | Chen | |
| 7,922,359 | B2 | 4/2011 | Chiang | |
| 7,922,363 | B2 | 4/2011 | Yang et al. | |
| 8,047,680 | B2 | 11/2011 | Huang et al. | |
| 8,082,977 | B2 | 12/2011 | Akaike et al. | |
| 8,092,045 | B2 | 1/2012 | Xiao et al. | |
| 8,152,341 | B2 | 4/2012 | Wheelock et al. | |
| 8,277,094 | B2 | 10/2012 | Wheelock et al. | |
| 2004/0004435 | A1 | 1/2004 | Hsu | |
| 2006/0176699 | A1 | 8/2006 | Crunk | |
| 2006/0285331 | A1 | 12/2006 | Wang et al. | |
| 2007/0070630 | A1 | 3/2007 | Kittredge et al. | |
| 2007/0147046 | A1 | 6/2007 | Arik et al. | |
| 2007/0267976 | A1 | 11/2007 | Bohler et al. | |
| 2008/0013316 | A1 | 1/2008 | Chiang | |
| 2009/0021944 | A1 | 1/2009 | Lee et al. | |
| 2009/0052187 | A1 | 2/2009 | Li | |
| 2009/0059594 | A1 | 3/2009 | Lin | |
| 2009/0195186 | A1 | 8/2009 | Guest et al. | |
| 2009/0257220 | A1 | 10/2009 | Lenk et al. | |
| 2009/0302991 | A1 | 12/2009 | Neilly et al. | |
| 2010/0134017 | A1 | 6/2010 | Yatsuda et al. | |
| 2010/0177519 | A1 | 7/2010 | Schlitz | |
| 2010/0225219 | A1 | 9/2010 | Hua | |
| 2010/0226137 | A1 | 9/2010 | Xiao et al. | |
| 2010/0246177 | A1 | 9/2010 | Van De Ven | |
| 2010/0301727 | A1 * | 12/2010 | Lenk et al. | 313/46 |
| 2011/0050098 | A1 | 3/2011 | Lenk et al. | |
| 2011/0193479 | A1 | 8/2011 | Nilssen et al. | |
| 2011/0305020 | A1 | 12/2011 | Wang | |
| 2012/0002401 | A1 | 1/2012 | Clifford | |

FOREIGN PATENT DOCUMENTS

| | | | |
|---|---|---|---|
| JP | 2013-506315 | A | 2/2013 |
| JP | 2013-528901 | A | 7/2013 |
| WO | 2004/100213 | A2 | 11/2004 |
| WO | 2011/036937 | A1 | 3/2011 |
| WO | 2011/133820 | A1 | 10/2011 |

OTHER PUBLICATIONS

International Search Report and Written Opinion received for PCT Patent Application No. PCT/US2012/23872, mailed on Jun. 12, 2012, 9 pages.

Non-Final Office Action received for U.S. Appl. No. 13/021,639, mailed on Jan. 23, 2012, 15 pages.

Notice of Allowance received for U.S. Appl. No. 13/419,373, mailed on Jul. 11, 2012, 8 pages.

Non-Final Office Action received for U.S. Appl. No. 13/019,237, mailed on Jan. 30, 2012, 17 pages.

Final Office Action received for U.S. Appl. No. 13/019,237, mailed on Aug. 10, 2012, 17 pages.

Exxon Mobil Corporation, "Univolt 60 Material Safety Data Bulletin", Nov. 5, 2002, 9 pages.

Office Action received for Japanese Patent Application No. 2013-552698, mailed on Jan. 7, 2014, 6 pages (3 pages of English Translation and 3 pages af JPOA).

International Preliminary Report on Patentability received for PCT Patent Application No. PCT/US2012/23872 mailed on Jan. 23, 2014, 7 pages.

International Preliminary Report on Patentability received for PCT Patent Application No. PCT/US2012/023521, mailed on Aug. 15, 2013, 7 pages.

Notice of Allowance received for U.S. Appl. No. 13/021,639, mailed on Mar. 6, 2012, 7 pages.

Non Final Office Action received for U.S. Appl. No. 13/631,660 mailed on Mar. 14, 2013, 14 pages.

Notice of Allowance received for U.S. Appl. No. 13/631,660, mailed on Jun. 18, 2013, 9 pages.

Supplemental Notice of Allowability received for U.S. Appl. No. 13/631,660, mailed on Sep. 11, 2013, 6 pages.

* cited by examiner

Side view

Front view

OMNI-DIRECTIONAL CHANNELING OF LIQUIDS FOR PASSIVE CONVECTION IN LED BULBS

BACKGROUND

1. Field

The present disclosure relates generally to light emitting-diode (LED) bulbs, and more particularly, to the efficient transfer of heat generated by LEDs in a liquid-filled LED bulb.

2. Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

While there are many advantages to using an LED bulb rather than an incandescent or fluorescent bulb, LEDs have a number of drawbacks that have prevented them from being as widely adopted as incandescent and fluorescent replacements. One drawback is that an LED, being a semiconductor, generally cannot be allowed to get hotter than approximately 120° C. As an example, A-type LED bulbs have been limited to very low power (i.e., less than approximately 8 W), producing insufficient illumination for incandescent or fluorescent replacements.

One potential solution to this problem is to use a large metallic heat sink attached to the LEDs and extending away from the bulb. However, this solution is undesirable because of the common perception that customers will not use a bulb that is shaped radically different from the traditionally shaped A-type form factor bulb. Additionally, the heat sink may make it difficult for the LED bulb to fit into pre-existing fixtures.

Another solution is to fill the bulb with a thermally conductive liquid to transfer heat from the LED to the shell of the bulb. The heat may then be transferred from the shell out into the air surrounding the bulb. However, current liquid-filled LED bulbs do not efficiently transfer heat from the LED to the liquid. Additionally, current liquid-filled LED bulbs do not allow the thermally conductive liquid to flow efficiently to transfer heat from the LED to the shell of the bulb. For example, in a conventional LED bulb having LEDs placed at the base of the bulb structure, the liquid heated by the LEDs rises to the top of the bulb and falls as it cools. However, the liquid does not flow efficiently because the shear force between the liquid rising up and the liquid falling down slows the convective flow of the liquid. Another drawback of current liquid-filled LED bulbs is that they do not efficiently dissipate heat when the bulb is not positioned in an upright orientation. When a conventional LED bulb is placed upside-down, for example, the heat-generating LEDs are flipped from the bottom of the bulb to the top of the bulb. This prevents an efficient convective flow within the bulb because the heated liquid remains at the top of the bulb near the LEDs.

Thus, an LED bulb capable of efficiently transferring heat away from the LEDs, while the LED bulb is in various orientations, is desired.

BRIEF SUMMARY

In one exemplary embodiment, an LED bulb has a base, a shell connected to the base, and a thermally conductive liquid held within the shell. The LED bulb has a plurality of LEDs mounted on LED mounting surfaces disposed within the shell. The LED mounting surfaces face different radial directions, and the LED mounting surfaces are configured to facilitate a passive convective flow of the thermally conductive liquid within the LED bulb to transfer heat from the LEDs to the shell when the LED bulb is oriented in at least three different orientations. In a first orientation, the shell is disposed vertically above the base. In a second orientation, the shell is disposed on the same horizontal plane as the base. In a third orientation, the shell is disposed vertically below the base.

In another exemplary embodiment, an LED bulb has a base, a shell connected to the base, and a thermally conducting liquid held within the shell. The LED bulb has a plurality of finger-shaped projections, disposed within the shell. The finger-shaped projections are separated by a plurality of channels formed between pairs of the plurality of finger-shaped projections for holding a plurality of LEDs. The plurality of finger-shaped projections and the plurality of channels are configured to facilitate a passive convective flow of the thermally conductive liquid through the plurality of channels, when the LED bulb is oriented in at least three different orientations. In a first orientation, the shell is disposed vertically above the base. In a second orientation, the shell is disposed on the same horizontal plane as the base. In a third orientation, the shell is disposed vertically below the base.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below, relating to LED bulbs. As used herein, an "LED bulb" refers to any light-generating device (e.g., a lamp) in which at least one LED is used to generate the light. Thus, as used herein, an "LED bulb" does not include a light-generating device in which a filament is used to generate the light, such as a conventional incandescent light bulb. It should be recognized that the LED bulb may have various shapes in addition to the bulb-like A-type shape of a conventional incandescent light bulb. For example, the bulb may have a tubular shape, globe shape, or the like. The LED bulb of the present disclosure may further include any type of connector; for example, a screw-in base, a dual-prong connector, a standard two- or three-prong wall outlet plug, bayonet base, Edison Screw base, single pin base, multiple pin base, recessed base, flanged base, grooved base, side base, or the like.

As used herein, the term "liquid" refers to a substance capable of flowing. Also, the substance used as the thermally conductive liquid is a liquid or at the liquid state within, at least, the operating ambient temperature range of the bulb. An exemplary temperature range includes temperatures between −40° C. to +40° C. Also, as used herein, "passive convective flow" refers to the circulation of a liquid without the aid of a fan or other mechanical devices driving the flow of the thermally conductive liquid.

Figure 1A:
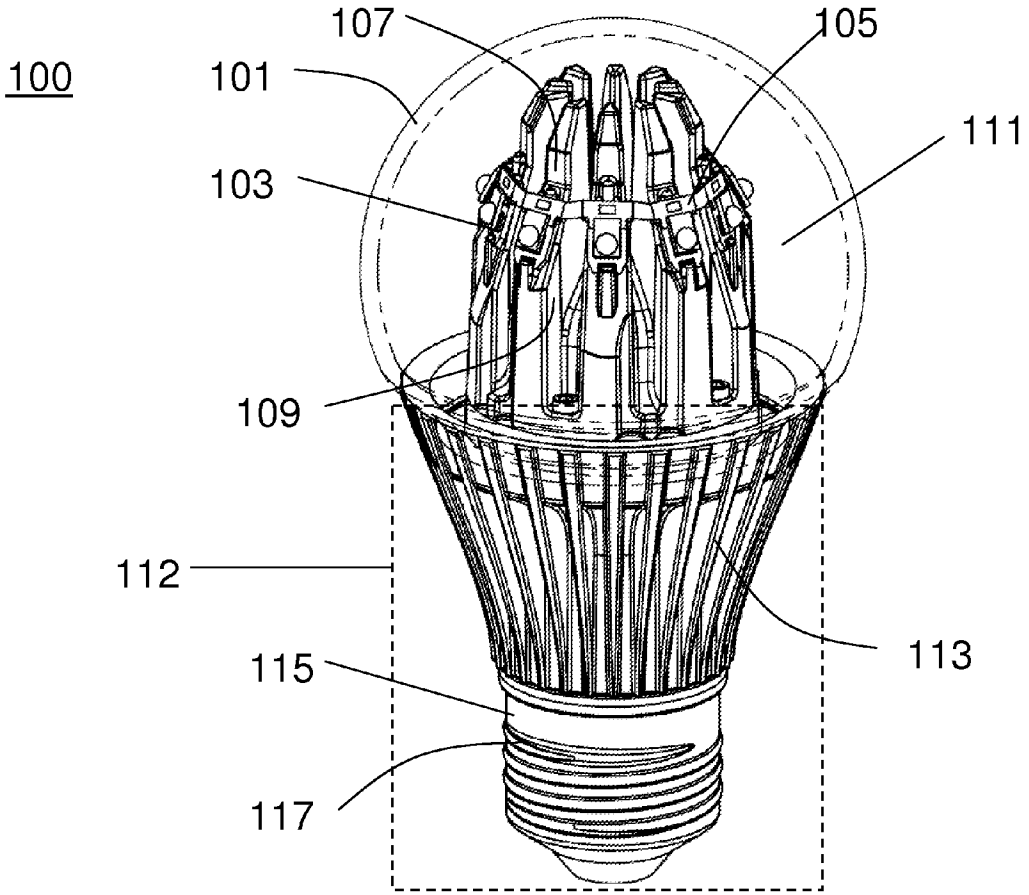
FIG. 1A illustrates an exemplary LED bulb.
Figure 1B:
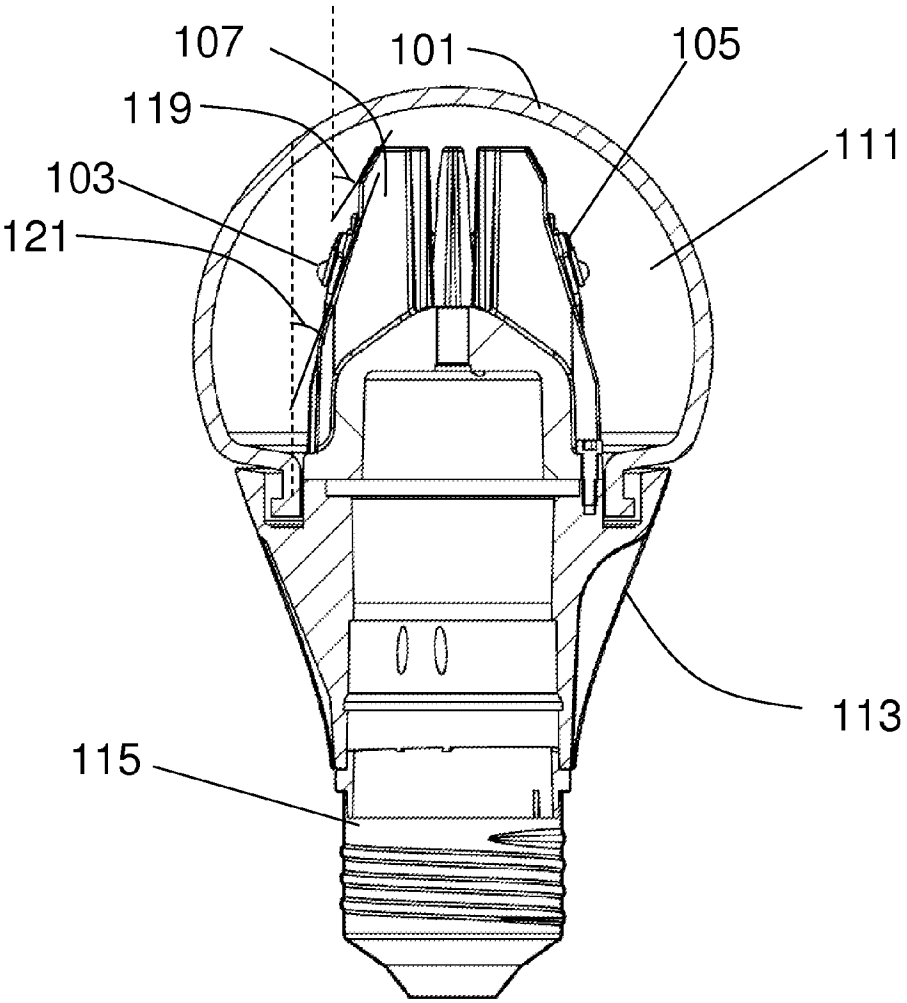
FIG. 1B illustrates a cross-sectional view of an exemplary LED bulb.

FIGS. 1A and 1B illustrate a perspective view and a cross-sectional view, respectively, of exemplary LED bulb 100. LED bulb 100 includes a base 112 and a shell 101 encasing the various components of LED bulb 100. For convenience, all examples provided in the present disclosure describe and show LED bulb 100 being a standard A-type form factor bulb. However, as mentioned above, it should be appreciated that the present disclosure may be applied to LED bulbs having any shape, such as a tubular bulb, globe-shaped bulb, or the like.

Shell 101 may be made from any transparent or translucent material such as plastic, glass, polycarbonate, or the like. Shell 101 may include dispersion material spread throughout the shell to disperse light generated by LEDs 103. The dispersion material prevents LED bulb 100 from appearing to have one or more point sources of light.

LED bulb 100 includes a plurality of LEDs 103 connected to LED mounts 107, which are disposed within shell 101. LED mounts 107 may be made of any thermally conductive material, such as aluminum, copper, brass, magnesium, zinc, or the like. Since LED mounts 107 are formed of a thermally conductive material, heat generated by LEDs 103 may be conductively transferred to LED mounts 107. Thus, LED mounts 107 may act as heat-sinks for LEDs 103.

In the present exemplary embodiment, thermal bed 105 is inserted between an LED 103 and an LED mount 107 to improve heat transfer between the two components. Thermal bed 105 may be made of any thermally conductive material, such as aluminum, copper, thermal paste, thermal adhesive, or the like. Thermal bed 105 may have a higher thermal conductivity than LED mount 107. For example, LED mount 107 may be formed of aluminum and thermal bed 105 may be formed of copper. It should be recognized, however, that thermal bed 105 may be omitted, and LED mount 107 can be directly connected to LEDs 103.

As depicted in FIG. 1A, in the present exemplary embodiment, LED mounts 107 are finger-shaped projections with a channel 109 formed between pairs of LED mounts 107. One advantage of such a configuration is increased heat dissipation due to the large surface-area-to-volume ratio of LED mounts 107. It should be recognized that LED mounts 107 may have various shapes other than that depicted in FIG. 1A in order to be finger-shaped projections. For example, LED mounts 107 may be straight posts with a channel formed between pairs of posts.

As depicted in FIG. 1B, in the present exemplary embodiment, top portions of LED mounts 107 may be angled or tapered at an angle 119, which is measured relative to a vertical line when LED bulb 100 is in a vertical position. Exemplary angle 119 includes a range of −35° to 90°. Also, all the top portions of LED mounts 107 can be angled or tapered at the same angle, such as 9° or 15°. Alternatively, a combination of angles can be used, such as half at 18° and half at 30°, or half at 9° and half at 31°. As will be described in greater detail below with respect to FIGS. 2A-2C, the angled top portions of LED mounts 107 may facilitate the passive convective flow of liquids within LED bulb 100.

As also depicted in FIG. 1B, in the present exemplary embodiment, LEDs 103 are connected to portions of LED mounts 107, which serve as mounting surfaces for LEDs 103, that are angled or tapered at an angle 121, which is measured relative to a vertical line when LED bulb 100 is in a vertical position. Exemplary angle 121 includes a range of −35° to 90°. Also, the portions of LED mounts 107 to which LEDs 103 are connected can be angled or tapered at the same angle, such as 9° or 15°. Alternatively, a combination of angles can be used, such as half at 18° and half at 30°, or half at 9° and half at 31°. The particular angle or angles may be selected to create a desirable photometric distribution.

In the present embodiment, as depicted in FIG. 1B, the angled or tapered portions on which LEDs 103 are connected (the mounting surfaces) are separate from the top portions of LED mounts 107, which are also angled or tapered. It should be recognized, however, that LEDs 103 can be connected on the top portions of LED mounts 107, which are angled or tapered.

In the present embodiment, LED bulb 100 is filled with thermally conductive liquid 111 for transferring heat generated by LEDs 103 to shell 101. Thermally conductive liquid 111 may be any thermally conductive liquid, mineral oil, silicone oil, glycols (PAGs), fluorocarbons, or other material capable of flowing. It may be desirable to have the liquid chosen be a non-corrosive dielectric. Selecting such a liquid can reduce the likelihood that the liquid will cause electrical shorts and reduce damage done to the components of LED bulb 100.

In the present embodiment, base 112 of LED bulb 100 includes a heat-spreader base 113. Heat-spreader base 113 may be made of any thermally conductive material, such as aluminum, copper, brass, magnesium, zinc, or the like. Heat-spreader base 113 may be thermally coupled to one or more of shell 101, LED mounts 107, and thermally conductive liquid 111. This allows some of the heat generated by LEDs 103 to be conducted to and dissipated by heat-spreader base 113.

The size and shape of LED mounts 107 may affect the amount of heat conducted to conductive liquid 111 and heat-spreader base 113. For example, when LED mounts 107 are formed to have a large surface-area-to-volume ratio, a large percentage of the total heat in LED mounts 107 may be conducted from LED mounts 107 to conductive liquid 111, while a small percentage of the total heat in LED mounts 107 may be conducted from LED mounts 107 to heat-spreader base 113. Where LED mounts 107 have a smaller surface-area-to-volume ratio, a small percentage of the total heat in LED mounts 107 may be conducted from LED mounts 107 to conductive liquid 111, while a large percentage of the total heat in LED mounts 107 may be conducted from LED mounts 107 to heat-spreader base 113.

In the present embodiment, base 112 of LED bulb 100 includes a connector base 115 for connecting the bulb to a lighting fixture. Connector base 115 may be a conventional light bulb base having threads 117 for insertion into a conventional light socket. However, it should be appreciated that connector base 115 may be any type of connector, such as a screw-in base, a dual-prong connector, a standard two- or three-prong wall outlet plug, bayonet base, Edison Screw base, single pin base, multiple pin base, recessed base, flanged base, grooved base, side base, or the like.

Figure 2A:
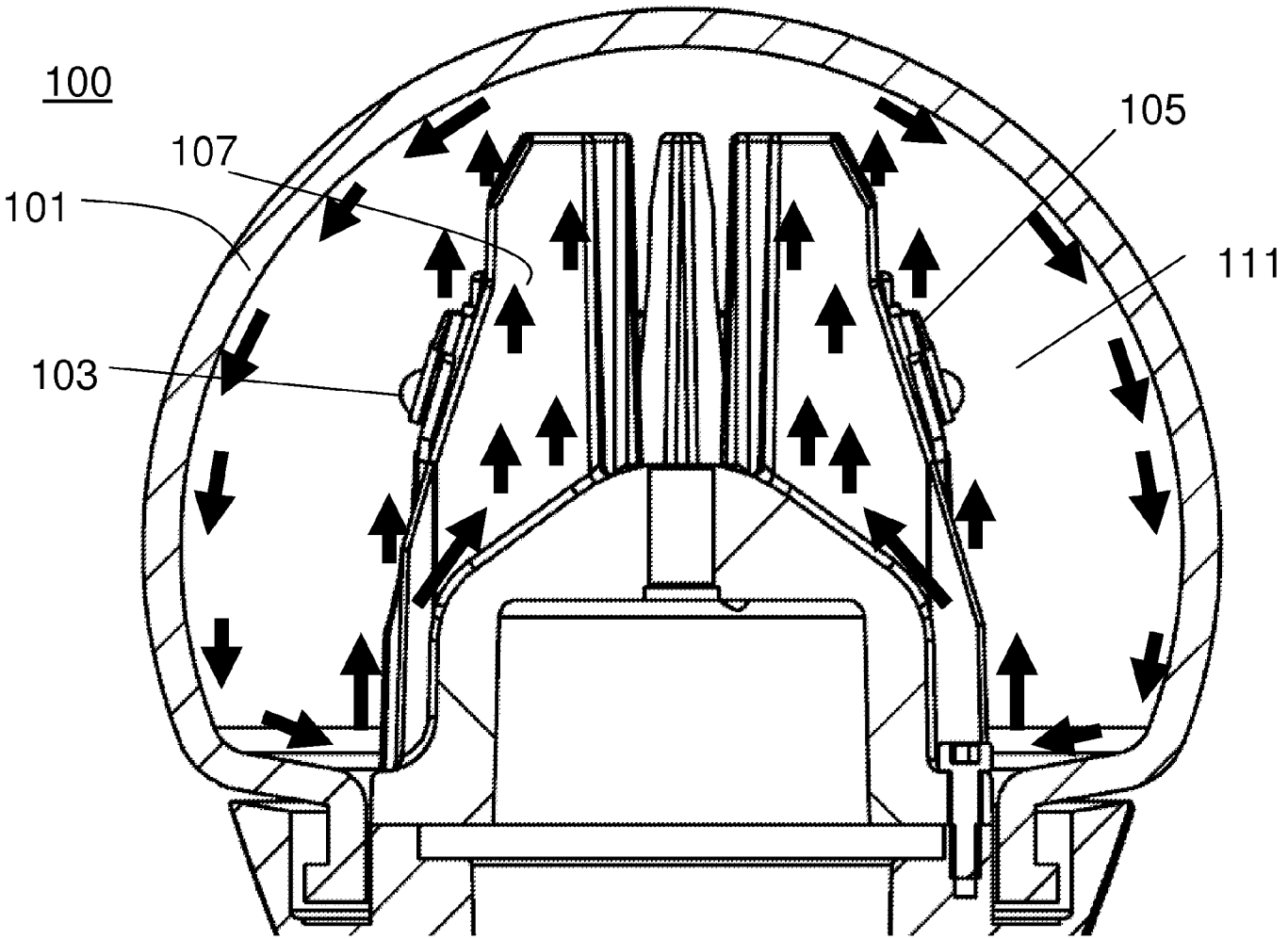
FIG. 2A illustrates a cross-sectional view of an exemplary LED bulb in a first orientation.
Figure 2B:
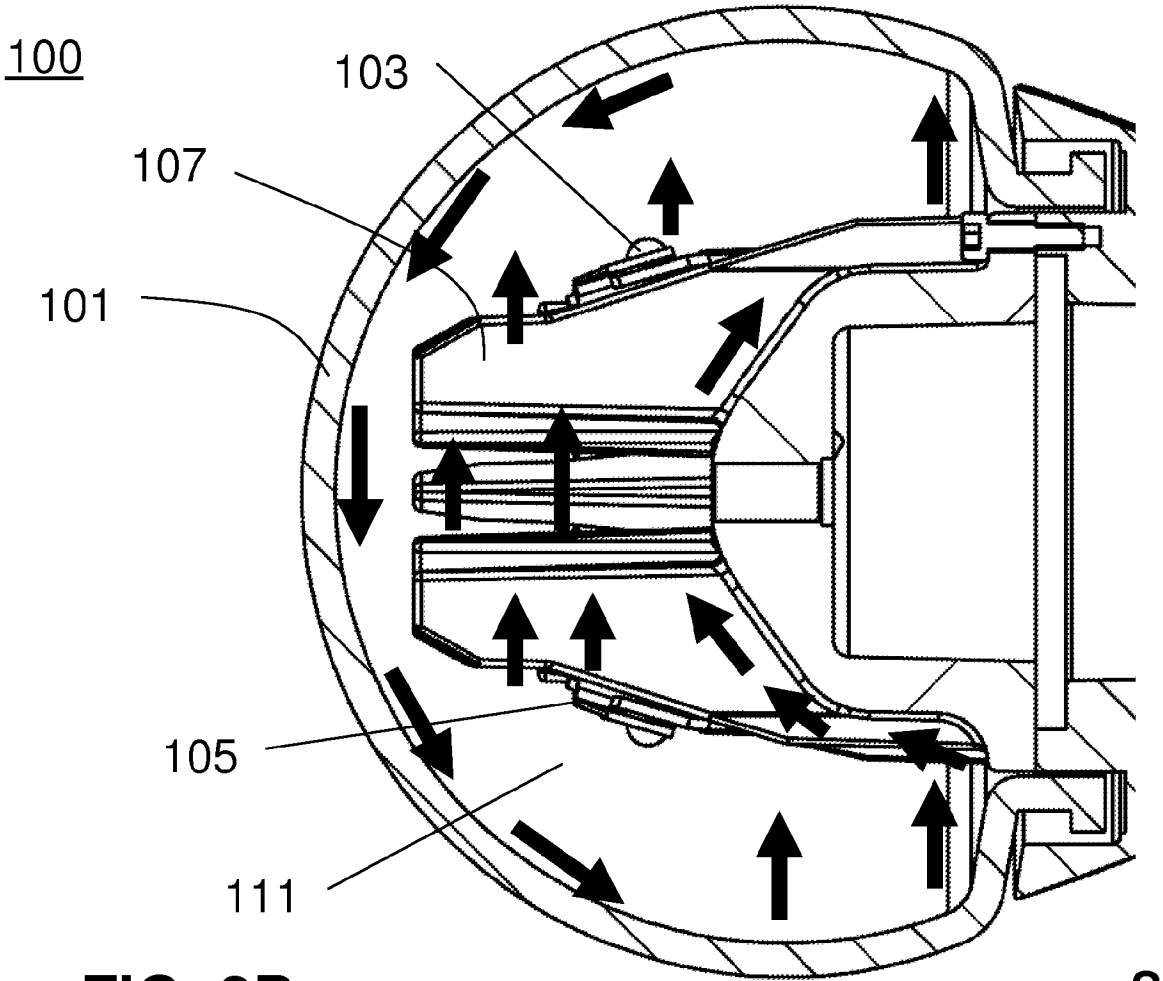
FIG. 2B illustrates a cross-sectional view of an exemplary LED bulb in a second orientation.
Figure 2B:
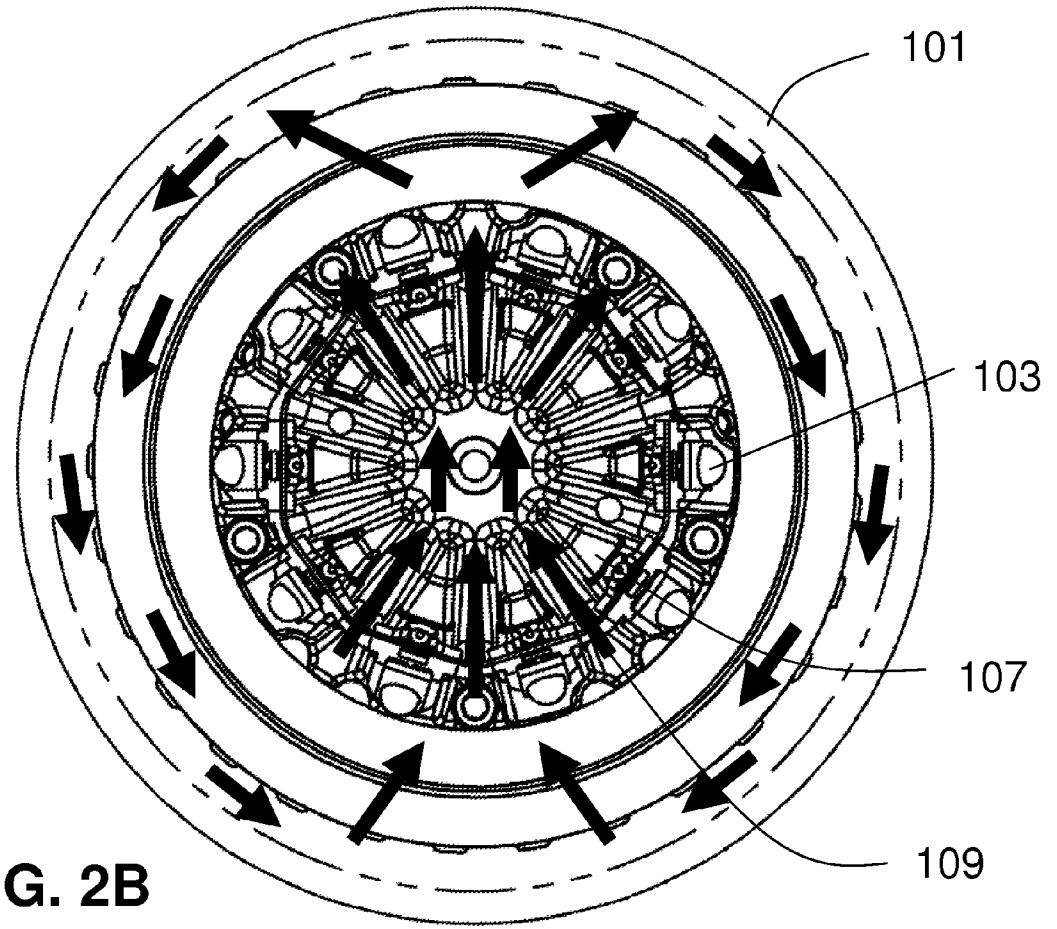
Figure 2C:
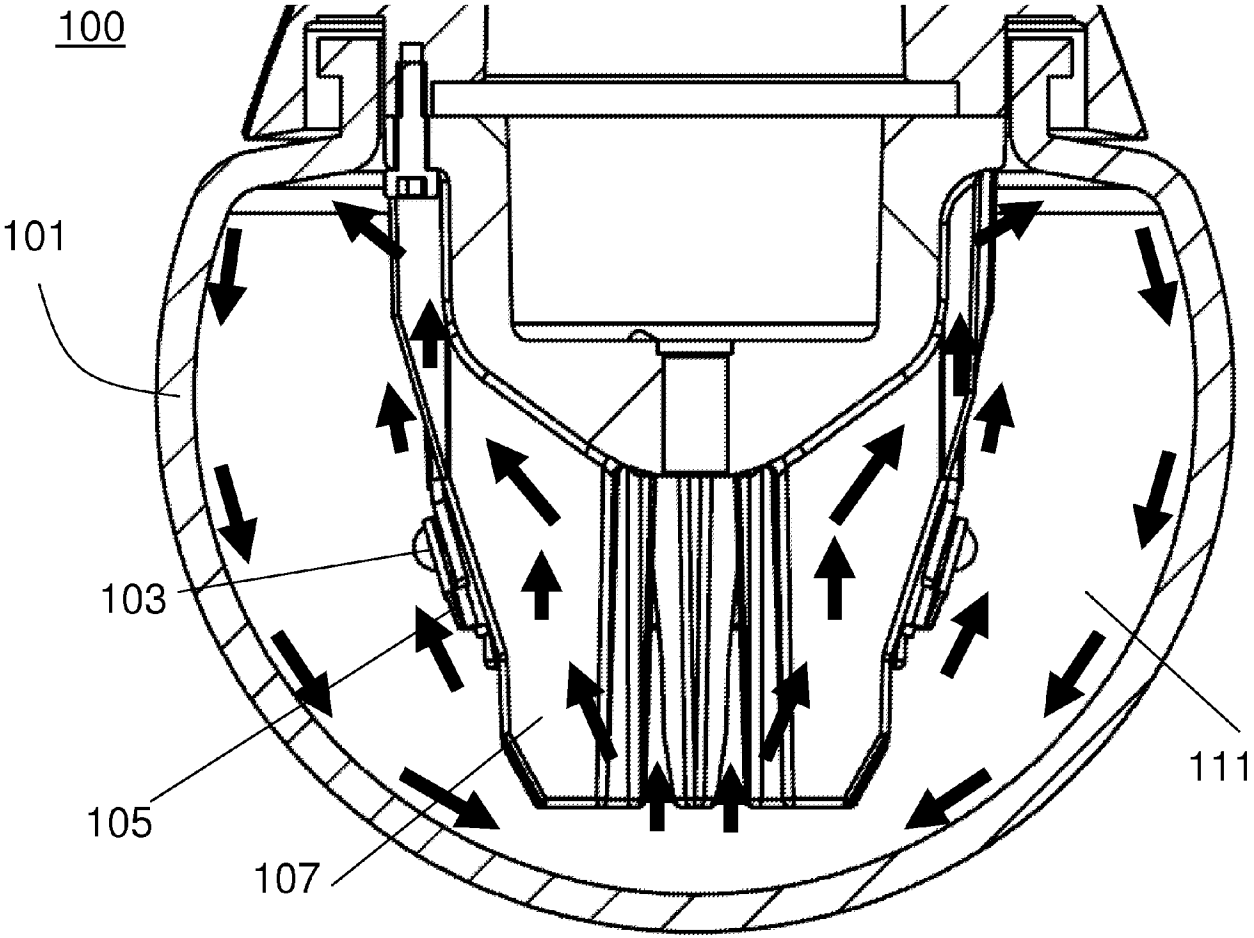
FIG. 2C illustrates a cross-sectional view of an exemplary LED bulb in a third orientation.

FIGS. 2A-2C illustrate the passive convective flow of thermally conductive liquid 111 overlaid on a cross-sectional view of LED bulb 100. In particular, FIG. 2A illustrates a cross-sectional view of the top portion of LED bulb 100 positioned in an upright vertical orientation in which shell 101 is disposed vertically above base 112. The arrows indicate the direction of liquid flow during operation of LED bulb 100. The liquid at the center of LED bulb 100 is shown rising towards the top of shell 101. This is due to the heat generated by LEDs 103 and conductively transferred to thermally conductive liquid 111 via LEDs 103 and LED mounts 107. As thermally conductive liquid 111 is heated, its density decreases relative to the surrounding liquid, thereby causing the heated liquid to rise to the top of shell 101.

As described above with respect to FIG. 1A, LED mounts 107 may be separated by channels 109. Separating LED mounts 107 with channels 109 not only increases the surface-area-to-volume ratio of LED mounts 107, but also facilitates an efficient passive convective flow of thermally conductive liquid 111 by allowing the flow of thermally conductive liquid 111 there between. For example, since the liquid along the surfaces of LED mounts 107 is heated faster than the surrounding liquid, an upward flow of thermally conductive liquid 111 is generated around LED mounts 107 and within channels 109. In one example, channels 109 may be shaped to form vertical channels pointing towards the top of shell 101. As a result, thermally conductive liquid 111 may be guided along the edges of channel 109 towards the top and center of shell 101.

Once the heated, thermally conductive liquid 111 reaches the top portion of shell 101, heat is conductively transferred to shell 101, causing thermally conductive liquid 111 to cool. As thermally conductive liquid 111 cools, its density increases, thereby causing thermally conductive liquid 111 to fall. In one example, as illustrated by FIGS. 1A-1B and FIGS. 2A-2C, the top portions of LED mounts 107 may be angled. The sloped surfaces of LED mounts 107 may direct the flow of the cooled, thermally conductive liquid 111 outwards and down the side surface of shell 101. By doing so, thermally conductive liquid 111 remains in contact with shell 101 for a greater period of time, allowing more heat to be conductively transferred to shell 101. In addition, since the downward flow of thermally conductive liquid 111 is concentrated along the surface of shell 101, the shear force between the upward flowing liquid at the center of LED bulb 100 and the downward flowing liquid along the surface of shell 101 is reduced, thereby increasing the convective flow of thermally conductive liquid 111 within LED bulb 100.

Once reaching the bottom of shell 101, thermally conductive liquid 111 flows inwards toward LED mounts 107 and rises as heat generated by LEDs 103 heats up the liquid. The heated, thermally conductive liquid 111 is again guided through channels 109 as described above. The described convective cycle continuously repeats during operation of LED bulb 100 to cool LEDs 103. It should be appreciated that the convective flow described above represents the general flow of liquid within shell 101. One of ordinary skill in the art will recognize that some of thermally conductive liquid 111 may not reach the top and bottom of shell 101 before being cooled or heated sufficiently to cause the liquid to fall or rise.

FIG. 2B illustrates two cross-sectional views of the top portion of LED bulb 100 positioned in a horizontal orientation in which shell 101 is disposed on the same plane as base 112. FIG. 2B includes both a side view of LED bulb 100 and a front view looking into the top portion of LED bulb 100. Similar to those in FIG. 2A, the arrows indicate the direction of liquid flow during operation of LED bulb 100. In the side view of FIG. 2B, the liquid at the center of LED bulb 100 is shown rising towards the top (previously side) of shell 101. This is due to the heat generated by LEDs 103 and conductively transferred to thermally conductive liquid 111 via LEDs 103 and LED mounts 107. As thermally conductive liquid 111 is heated, its density decreases, thereby causing the heated liquid to rise to the top (previously side) of LED bulb 100.

As described above with respect to FIG. 1A, LED mounts 107 may be separated by channels 109. Separating LED mounts 107 with channels 109 not only increases the surface-area-to-volume ratio of LED mounts 107, but may also facilitate an efficient passive convective flow of thermally conductive liquid 111 by directing the flow of thermally conductive liquid 111. For example, since the liquid along the surfaces of LED mounts 107 is heated faster than the surrounding liquid, a flow of thermally conductive liquid 111 is generated around LED mounts 107 and within channels 109. In one example, as illustrated by the front view of FIG. 2B, channels 109 may be shaped to point radially outward, from a top-down view. As indicated by the arrows representing the liquid flow, channels 109 may guide the heated, thermally conductive liquid 111 radially outwards along the edges of channels 109 towards shell 101. This may generate an efficient convective flow of liquid as shown by FIG. 2B. Additionally, channels 109 may further facilitate an efficient passive convective flow of thermally conductive liquid 111 by allowing thermally conductive liquid 111 to flow between LED mounts 107 rather than having to go around the entire mounting structure.

Once the heated, thermally conductive liquid 111 reaches the top (previously side) portion of shell 101, heat is conductively transferred to shell 101, causing thermally conductive liquid 111 to cool. As thermally conductive liquid 111 cools, its density increases, thereby causing thermally conductive liquid 111 to fall. In one example, as illustrated by FIGS. 1A-1B and FIGS. 2A-2C, the top portion of LED mount 107 may be angled inwards towards the center of LED bulb 100. As illustrated by the side view of FIG. 2B, the sloped surface of LED mount 107 may direct the flow of the cooled, thermally conductive liquid 111 down the side (previously top) surface of shell 101. By doing so, thermally conductive liquid 111 remains in contact with shell 101 for a greater period of time, allowing more heat to be conductively transferred to shell 101.

As illustrated by the front view of FIG. 2B, the top-view profile of LED mounts 107 may be similar to the shape of shell 101. In the illustrated example, this shape is a circle. However, it should be appreciated that shell 101 and LED mounts 107 may be formed into any other desired shape. As depicted in FIG. 2B, the LED mounting surfaces face different radial directions. As a result of LED mounts 107 conforming to the shape of shell 101, the outer side surfaces of LED mounts 107 may guide the flow of the cooled, thermally conductive liquid 111 down the side surfaces of shell 101. By doing so, thermally conductive liquid 111 remains in contact with shell 101 for a greater period of time, allowing more heat to be conductively transferred to shell 101. Since the downward flow of thermally conductive liquid 111 is concentrated on the outer surface of shell 101, the shear force between the upward flowing liquid at the center of LED bulb 100 and the downward flowing liquid along the surface of shell 101 is reduced, thereby increasing the convective flow of thermally conductive liquid 111 within LED bulb 100.

Once reaching the bottom of shell 101, thermally conductive liquid 111 flows towards LED mounts 107 and rises as heat generated by LEDs 103 heats up the liquid. The heated thermally conductive liquid 111 is again guided through channels 109 as described above. The described convective cycle continuously repeats during operation of LED bulb 100 to cool LEDs 103. It should be appreciated that the convective flow described above represents the general flow of liquid within shell 101. One of ordinary skill in the art will recognize that some of thermally conductive liquid 111 may not reach the top and bottom of shell 101 before being cooled or heated sufficiently to cause the liquid to fall or rise.

FIG. 2C illustrates a cross-sectional view of the top portion of LED bulb 100 positioned in an upside-down vertical orientation in which shell 101 is disposed vertically below base 112. The arrows indicate the direction of liquid flow during operation of LED bulb 100. The liquid at the center of LED bulb 100 is shown rising towards the top (previously bottom) of shell 101. This is due to the heat generated by LEDs 103 and conductively transferred to thermally conductive liquid 111 via LEDs 103 and LED mounts 107. As thermally conductive liquid 111 is heated, its density decreases, thereby causing the heated liquid to rise to the top (previously bottom) of LED bulb 100.

In one example, as described above with respect to FIG. 1A, LED mounts 107 may be separated by channels 109. Separating LED mounts 107 with channels 109 not only increases the surface-area-to-volume ratio of LED mounts 107, but may also facilitate an efficient passive convective flow of thermally conductive liquid 111 by directing the flow of thermally conductive liquid 111. For example, since the liquid along the surfaces of LED mounts 107 is heated faster than the surrounding liquid, an upward flow of thermally conductive liquid 111 is generated around LED mounts 107 and within channels 109. In one example, channels 109 may be shaped to form vertical channels pointing towards the bottom (previously top) of shell 101. As a result, thermally conductive liquid 111 may be guided along the vertical edges of channel 109 towards the top (previously bottom) of shell 101.

Once the heated, thermally conductive liquid 111 reaches the top (previously bottom) portion of shell 101, heat is conductively transferred to shell 101, causing thermally conductive liquid 111 to cool. As thermally conductive liquid 111 cools, its density increases, thereby causing thermally conductive liquid 111 to fall. Since the heated, thermally conductive liquid 111 is forced up and outwards in an upside-down vertical orientation, the cooled, thermally conductive liquid 111 falls down the sides of shell 101. This allows thermally conductive liquid 111 to remain in contact with shell 101 for a greater period of time, allowing more heat to be conductively transferred to shell 101. In addition, since the downward flow of thermally conductive liquid 111 is concentrated along the surface of shell 101, the shear force between the upward flowing liquid at the center of LED bulb 100 and the downward flowing liquid along the surface of shell 101 is reduced, thereby increasing the convective flow of thermally conductive liquid 111 within LED bulb 100.

Once reaching the bottom (previously top) of shell 101, thermally conductive liquid 111 may move towards the center of LED bulb 100 and rise as heat generated by LEDs 103 heats up the liquid. In one example, as illustrated by FIGS. 1A-1B and FIGS. 2A-2C, the bottom (previously top) portions of LED mounts 107 may be angled inwards towards the center of LED bulb 100. The sloped surface of LED mount 107 may direct the flow of the heated, thermally conductive liquid 111 outwards and upwards to the top (previously bottom) portion of shell 101, as illustrated by FIG. 2C. The heated, thermally conductive liquid 111 may be further guided through channels 109 towards the top (previously bottom) portion of shell 101. The described convective cycle continuously repeats during operation of LED bulb 100 to cool LEDs 103. It should be appreciated that the convective flow described above represents the general flow of liquid within shell 101. One of ordinary skill in the art will recognize that some of thermally conductive liquid 111 may not reach the top and bottom of shell 101 before being cooled or heated sufficiently to cause the liquid to fall or rise.

In the examples described above with respect to FIG. 2C, a passive convective flow of thermally conductive liquid 111 throughout shell 101 is improved by the inclusion of the central structure comprising LED mounts 107. Providing LEDs 103 on LED mounts 107 near the center of shell 101 avoids the situation described above with respect to a conventional LED bulb where the heat-generating elements (LEDs) are positioned at the top of the bulb.

Although a feature may appear to be described in connection with a particular embodiment, one skilled in the art would recognize that various features of the described embodiments may be combined. Moreover, aspects described in connection with an embodiment may stand alone.

What is claimed is:

1. A light emitting diode (LED) bulb comprising:
- a base;
- a shell connected to the base;
- a thermally conductive liquid held within the shell;
- a plurality of LEDs; and
- a plurality of LED mounting surfaces disposed within the shell, wherein each LED is mounted to one of the LED mounting surfaces, wherein the LED mounting surfaces face different radial directions, and wherein the LED mounting surfaces are configured to facilitate a passive convective flow of the thermally conductive liquid within the LED bulb to transfer heat from the LEDs to the shell when the LED bulb is oriented in at least three different orientations, the at least three different orientations comprising:
  - a first orientation in which the shell is disposed vertically above the base;
  - a second orientation in which the shell is disposed on the same horizontal plane as the base; and
  - a third orientation in which the shell is disposed vertically below the base; wherein the LED mounting surfaces are portions of LED mounts, and wherein the LED mounts are finger-shaped projections, wherein the finger-shaped projections project into the thermally conductive liquid held within the shell.

2. The LED bulb of claim 1, wherein the LEDs are immersed in the thermally conductive liquid.

3. The LED bulb of claim 1, wherein the LED mounting surfaces are immersed in the thermally conductive liquid.

4. The LED bulb of claim 1, further comprising:
- a plurality of channels formed between pairs of the finger-shaped projections, wherein the finger-shaped projections and the plurality of channels are configured to facilitate a passive convective flow of the thermally conductive liquid through the plurality of channels when the LED bulb is oriented in the at least three different orientations.

5. The LED bulb of claim 4, wherein the plurality of channels is configured to direct the thermally conductive liquid to flow up away from the base through the plurality of channels in the center of the LED bulb and flow down a surface of the shell in the first orientation.

6. The LED bulb of claim 4, wherein the plurality of channels is configured to direct the thermally conductive liquid to flow up through the plurality of channels and down a surface of the shell in the second orientation.

7. The LED bulb of claim 4, wherein the plurality of channels is configured to direct the thermally conductive liquid to flow up towards the base through the plurality of channels in the center of the LED bulb and flow down a surface of the shell in the third orientation.

8. The LED bulb of claim 4, wherein the plurality of channels is configured to direct the thermally conductive liquid to convectively flow to transfer heat from the plurality of LEDs and the finger-shaped projections to the shell, when the plurality of LEDs is turned on.

9. The LED bulb of claim 4, wherein the plurality of finger-shaped projections and the plurality of channels point radially outward from the center of the shell.

10. The LED bulb of claim 1, wherein each of the finger-shaped projections includes an angled top portion.

11. The LED bulb of claim 1, wherein the LED mounting surfaces are angled relative to a vertical line when the LED bulb is in a vertical position.

12. The LED bulb of claim 1 further comprising at least one thermal bed disposed between at least one of the LEDs and at least one of the LED mounting surfaces.

13. The LED bulb of claim 12, wherein the at least one thermal bed has a higher thermal conductivity than the at least one of the LED mounting surfaces.

14. The LED bulb of claim 1, wherein the base comprises:

a heat-spreader base connected to the finger-shaped projections, wherein the heat-spreader base is configured to conductively transfer heat from the finger-shaped projections; and a connector base configured to connect the LED bulb to a fixture.

15. The LED bulb of claim 14, wherein the connector base includes threads.

16. The LED bulb of claim 1, wherein the thermally conductive liquid is a member of the group consisting of a mineral oil, silicone oil, glycols, and fluorocarbons.

17. A method of making a light emitting diode (LED) bulb, comprising:

obtaining a base;

connecting a shell to the base;

filling the shell with a thermally conductive liquid;

disposing a plurality of LED mounting surfaces within the shell; and mounting a plurality of LEDs on the LED mounting surfaces, wherein each LED is mounted to one of the LED mounting surfaces, wherein the LED mounting surfaces face different radial directions, and wherein the LED mounting surfaces are configured to facilitate a passive convective flow of the thermally conductive liquid within the LED bulb to transfer heat from the LEDs to the shell when the LED bulb is oriented in at least three different orientations, the at least three different orientations comprising:

a first orientation in which the shell is disposed vertically above the base;

a second orientation in which the shell is disposed on the same horizontal plane as the base; and a third orientation in which the shell is disposed vertically below the base; wherein the LED mounting surfaces are portions of LED mounts, and wherein the LED mounts are finger-shaped projections, wherein the finger-shaped projections project into the thermally conductive liquid held within the shell.

18. The method of claim 17, wherein the LEDs and LED mounting surfaces are immersed in the thermally conductive liquid.

19. The method of claim 17, further comprising:

a plurality of channels formed between pairs of the finger-shaped projections, wherein the finger-shaped projections and the plurality of channels are configured to facilitate a passive convective flow of the thermally conductive liquid through the plurality of channels while the LED bulb is oriented in the at least three different orientations.

20. The method of claim 19, wherein the plurality of channels is configured to direct the thermally conductive liquid to flow up away from the base through the plurality of channels in the center of the LED bulb and flow down a surface of the shell in the first orientation.

21. The method of claim 19, wherein the plurality of channels is configured to direct the thermally conductive liquid to flow up through the plurality of channels and down a surface of the shell in the second orientation.

22. The method of claim 19, wherein the plurality of channels is configured to direct the thermally conductive liquid to flow up towards the base through the plurality of channels in the center of the LED bulb and flow down a surface of the shell in the third orientation.

23. The method of claim 19, wherein the plurality of channels is configured to direct the thermally conductive liquid to convectively flow to transfer heat from the plurality of LEDs and the finger-shaped projections to the shell, when the plurality of LEDs is turned on.

24. The method of claim 19, wherein the plurality of finger-shaped projections and the plurality of channels point radially outward from the center of the shell.

25. The method of claim 17, wherein each of the finger-shaped projections includes an angled top portion.

26. The method of claim 17, wherein the LED mounting surfaces are angled relative to a vertical line when the LED bulb is in a vertical position.

27. The method of claim 17, wherein the base comprises:

a heat-spreader base connected to the finger-shaped projections, wherein the heat-spreader base is configured to conductively transfer heat from the finger-shaped projections; and a connector base configured to connect the LED bulb to a fixture.

* * * * *

UNITED STATES PATENT AND TRADEMARK OFFICE

CERTIFICATE OF CORRECTION

PATENT NO. : 8,686,623 B2
APPLICATION NO. : 13/963943
DATED : April 1, 2014
INVENTOR(S) : Glenn Wheelock et al.

It is certified that error appears in the above-identified patent and that said Letters Patent is hereby corrected as shown below:

On the Title Page

On page 2, item (56) under "OTHER PUBLICATIONS", in column 2, line 16, delete "af" and insert -- of --, therefor.

Signed and Sealed this
Twelfth Day of August, 2014

Michelle K. Lee

Michelle K. Lee
*Deputy Director of the United States Patent and Trademark Office*